US005159941A

United States Patent [19]

Tornatore

[11] Patent Number: 5,159,941

[45] Date of Patent: Nov. 3, 1992

[54] ASHTRAY APPARATUS

[76] Inventor: Joseph Tornatore, 111 Clevenger Dr., Clayton, N.J. 08312

[21] Appl. No.: 751,177

[22] Filed: Aug. 28, 1991

[51] Int. Cl.[5] ..... A24F 13/18; A24F 13/22; A24F 19/14

[52] U.S. Cl. ..... 131/236; 131/241; 131/242; 131/242.6

[58] Field of Search ..... 131/231, 236, 242, 242.6, 131/235.1, 240.1, 241; 220/372; 296/37.9, 37.11; D27/102, 105, 110, 138

[56] References Cited

U.S. PATENT DOCUMENTS

| | | | |
|---|---|---|---|
| 2,536,480 | 1/1951 | Wheler | 131/242 |
| 2,593,836 | 4/1952 | Bock | 121/242 X |
| 3,606,893 | 9/1971 | Verberg | 131/236 X |
| 3,920,028 | 11/1975 | Kobayakawa | 131/236 |
| 4,953,571 | 9/1990 | Tremblay | 131/235.1 X |

*Primary Examiner*—Vincent Millin
*Assistant Examiner*—J. Doyle
*Attorney, Agent, or Firm*—Leon Gilden

[57] ABSTRACT

An apparatus defined by an enclosed housing, with a first embodiment including a lid, with the lid provided with a central tray and the tray including a central tray aperture. The tray aperture is coaxially aligned with an underlying fluid containing bucket, wherein the fluid is of an aqueous deodorizing mixture. A granular base is deposited upon the housing floor in surrounding relationship relative to the bucket. A modification of the invention includes the housing, with a door mounted to the front wall thereof for access to the bucket container containing an upwardly projecting basket, wherein the bucket and basket are slidably mounted upon spaced parallel tracks positioned to permit insertion and removal of the bucket housing relative to the housing of the organization. The top wall of the housing includes a perimeter mesh gutter directing ashes and the like through a funnel conduit into the basket structure, with the top wall of the housing including a convex upper surface within the trough construction to include a central opening aligned with the underlying basket container.

6 Claims, 5 Drawing Sheets

PRIOR ART

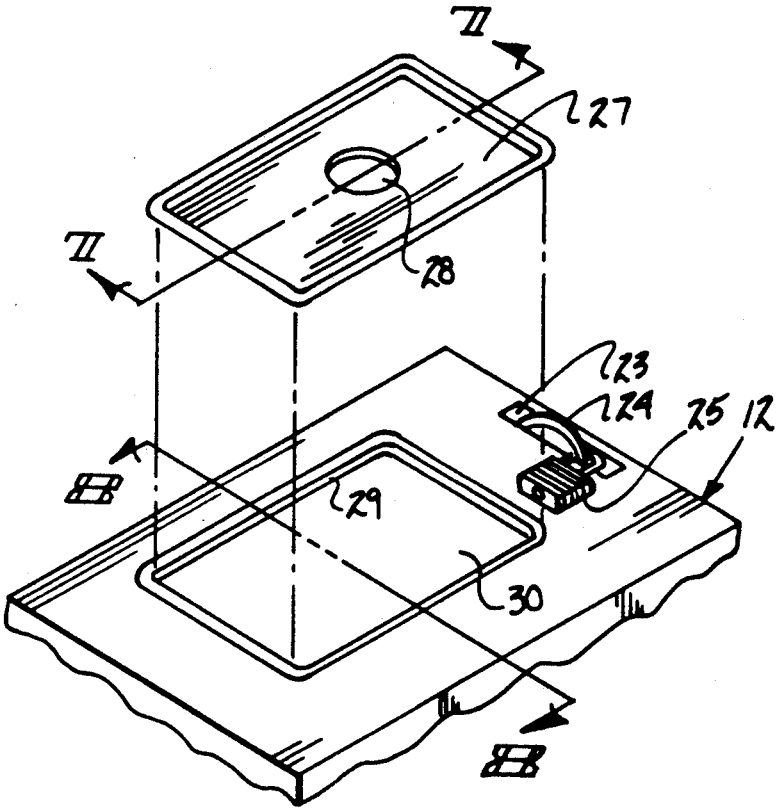
FIG 6
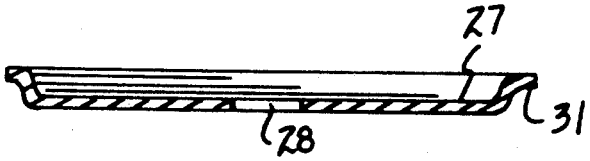
FIG 7
FIG 8
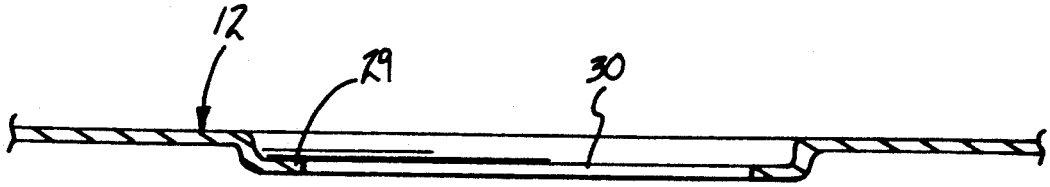

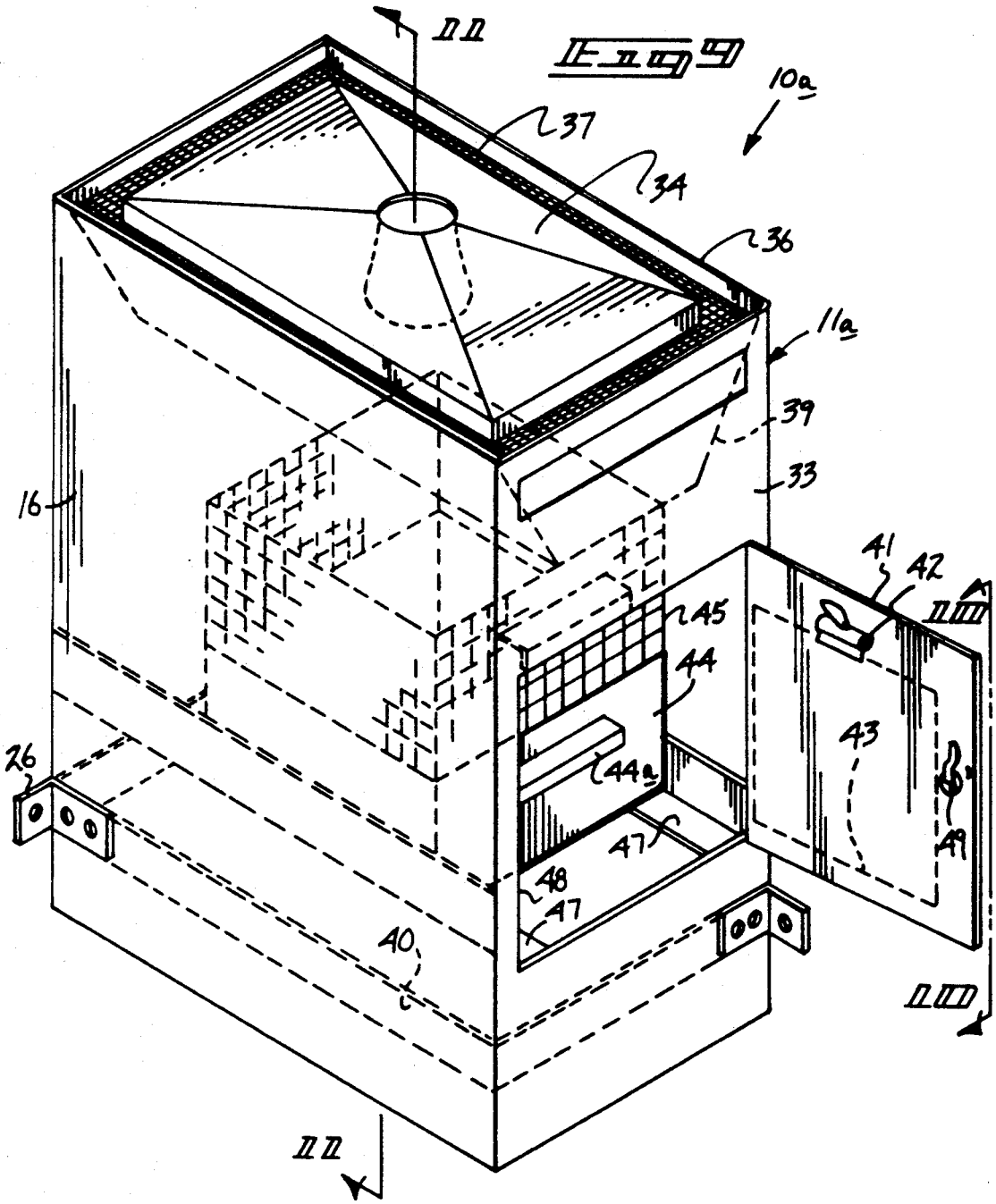
Fig 9
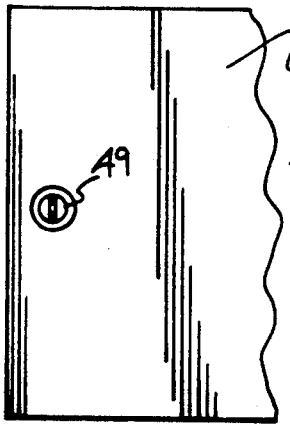
Fig III

ASHTRAY APPARATUS

BACKGROUND OF THE INVENTION

1. Field of the Invention

The field of invention relates to ashtray apparatus, and more particularly pertains to a new and improved ashtray apparatus to accommodate cigarette ash and debris in a sanitary and convenient manner.

2. Description of the Prior Art

Various ash tray apparatus has been utilized in the prior art for the disposal and containment of cigarette debris, such as smoldering and discarded cigarette and cigar butts. Prior art structure is exemplified in U.S. Pat. No. 4,550,738 to Estey wherein a sanitary ashtray system includes venting exhaust conduits for directing smoke exteriorly of the housing of the organization.

U.S. Pat. No. 3,698,401 to Tucker sets forth a tobacco ash receiver for use in automotive environments.

U.S. Pat. No. 3,426,762 to Vitale sets forth a cigarette holder and ash receiver to secure a cigarette butt to further include a quench receptacle having a lid with a wicker and dropper tube directed therethrough.

U.S. Pat. No. 4,346,719 to Hilkene utilizes a cigarette extinguisher apparatus utilizing fluid within a compartment directed into a granular adjacent chamber, wherein capillary action through the granular chamber effects extinguishing of cigarettes within the granular chamber.

As such, it may be appreciated that there continues to be a need for a new and improved ashtray apparatus as set forth by the instant invention which addresses both the problems of ease of use as well as effectiveness of construction and in this respect, the present invention substantially fulfills this need.

SUMMARY OF THE INVENTION

In view of the foregoing disadvantages inherent in the known types of ashtray apparatus now present in the prior art, the present invention provides an ashtray apparatus wherein the same utilizes an enclosed housing containing a serviceable container to include an aqueous extinguishing and deodorizing fluid contained therewithin. As such, the general purpose of the present invention, which will be described subsequently in greater detail, is to provide a new and improved ashtray apparatus which has all the advantages of the prior art ashtray apparatus and none of the disadvantages.

To attain this, the present invention provides an apparatus defined by an enclosed housing, with a first embodiment including a lid, with the lid provided with a central tray and the tray including a central tray aperture. The tray aperture is coaxially aligned with an underlying fluid containing bucket, wherein the fluid is of an aqueous deodorizing mixture. A granular base is deposited upon the housing floor in surrounding relationship relative to the bucket. A modification of the invention includes the housing, with a door mounted to the front wall thereof for access to the bucket container containing an upwardly projecting basket, wherein the bucket and basket are slidably mounted upon spaced parallel tracks positioned to permit insertion and removal of the bucket housing relative to the housing of the organization. The top wall of the housing includes a perimeter mesh gutter directing ashes and the like through a funnel conduit into the basket structure, with the top wall of the housing including a convex upper surface within the trough construction to include a central opening aligned with the underlying basket container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract in neither intended to define the invention of the application, which is measured by the claims, nor is it intended to be limiting as to the scope of the invention in any way.

It is therefore an object of the present invention to provide a new and improved ashtray apparatus which has all the advantages of the prior art ashtray apparatus and none of the disadvantages.

It is another object of the present invention to provide a new and improved ashtray apparatus which may be easily and efficiently manufactured and marketed.

It is further object of the present invention to provide a new and improved ashtray apparatus which is of a durable and reliable construction.

An even further object of the present invention is to provide a new and improved ashtray apparatus which is susceptible of a low cost of manufacture with regard to both materials and labor, and which accordingly is then susceptible of low prices of sale to the consuming public, thereby making such ashtray apparatus economically available to the buying public.

Still yet another object of the present invention is to provide a new and improved ashtray apparatus which provides in the apparatuses and methods of the prior art some of the advantages thereof, while simultaneously overcoming some of the disadvantages normally associated therewith.

These togeher with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of the tray structure mounted within the lid of the invention.

FIG. 7 is an orthographic view, taken along the lines 7—7 of FIG. 6 in the direction indicated by the arrows.

FIG. 8 is an orthographic view, taken along the lines 8—8 of FIG. 6 in the direction indicated by the arrows.

FIG. 9 is an isometric illustration of a modified ashtray apparatus utilized by the invention.

FIG. 10 is an orthographic view, taken along the lines 10—10 of FIG. 9 in the direction indicated by the arrows.

DESCRIPTION OF THE PREFERRED EMBODIMENT

Figure 1:
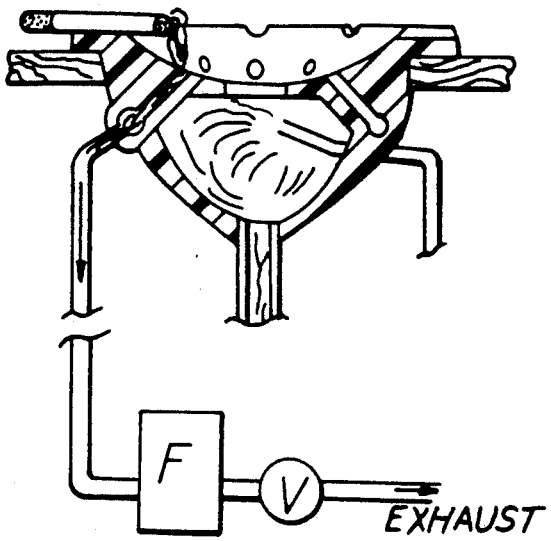
FIG. 1 is an orthographic view, partially in section, of a prior art ashtray apparatus.

With reference now to the drawings, and in particular to FIGS. 1 to 12 thereof, a new and improved ashtray apparatus embodying the principles and concepts of the present invention and generally designated by the reference numerals 10 and 10*a* will be described.

Figure 2:
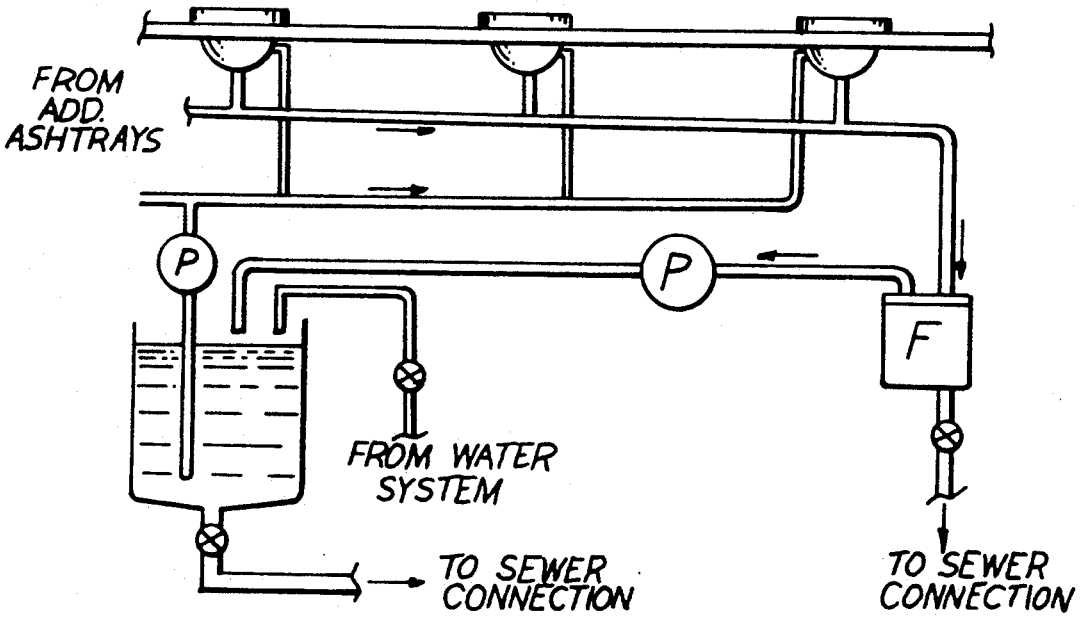
PRIOR ART Fig 2
FIG. 2 is a diagrammatic illustration of the ashtray apparatus of the prior art, as set forth in FIG. 1, in a series organization.

FIGS. 1 and 2 are illustrative of a typical prior art ashtray apparatus as set forth in U.S. Pat. No. 4,550,738 to utilize a smoke removal system directed into a water system through a filter. The reservoir is described as including deodorizing and disinfecting chemicals in the water.

More specifically, the ashtray apparatus 10 of the instant invention essentially comprises a housing container 11 including a lid 12 hingedly mounted to the housing container to a front wall 14 thereof by use of a hinge 17. The housing container 11 includes a rear wall 15, side walls 16, and a floor 13. The floor 13 includes a quantity of granular material 19 positioned within the housing container within a housing cavity 18 defined by the housing container 11 to position a bucket 20. The bucket 20 mounted within the granular material 19 includes a fluid 21 of an aqueous solution of water and deodorizing chemicals.

A cigarette member 22 is directed into the bucket 20 and the fluid 21 through a tray plate 27 formed within the lid 12. The tray plate 27 includes a tray plate opening 28 coaxially aligned with the bucket 20. The tray plate 27 is mounted fixedly to a lid mounting flange 29 formed centrally of the lid 12 defining a central opening 30 to receive the tray plate 27. The tray plate includes a tray plate flange 31 to overlie the mounting flange 29. Mounting brackets 26 are secured to walls of the housing container, as required, to fasten the housing container 11 to various vertical wall structure to fixedly position the housing container 11 in a predetermined orientation. The lid 12 includes a lid slot 23 to receive a locking loop 24 that in turn is fixedly mounted to the rear wall 15 and projects upwardly through the slot 23 to receive a lock member 25 to provide selective opening of the lid, as required.

Figure 3:
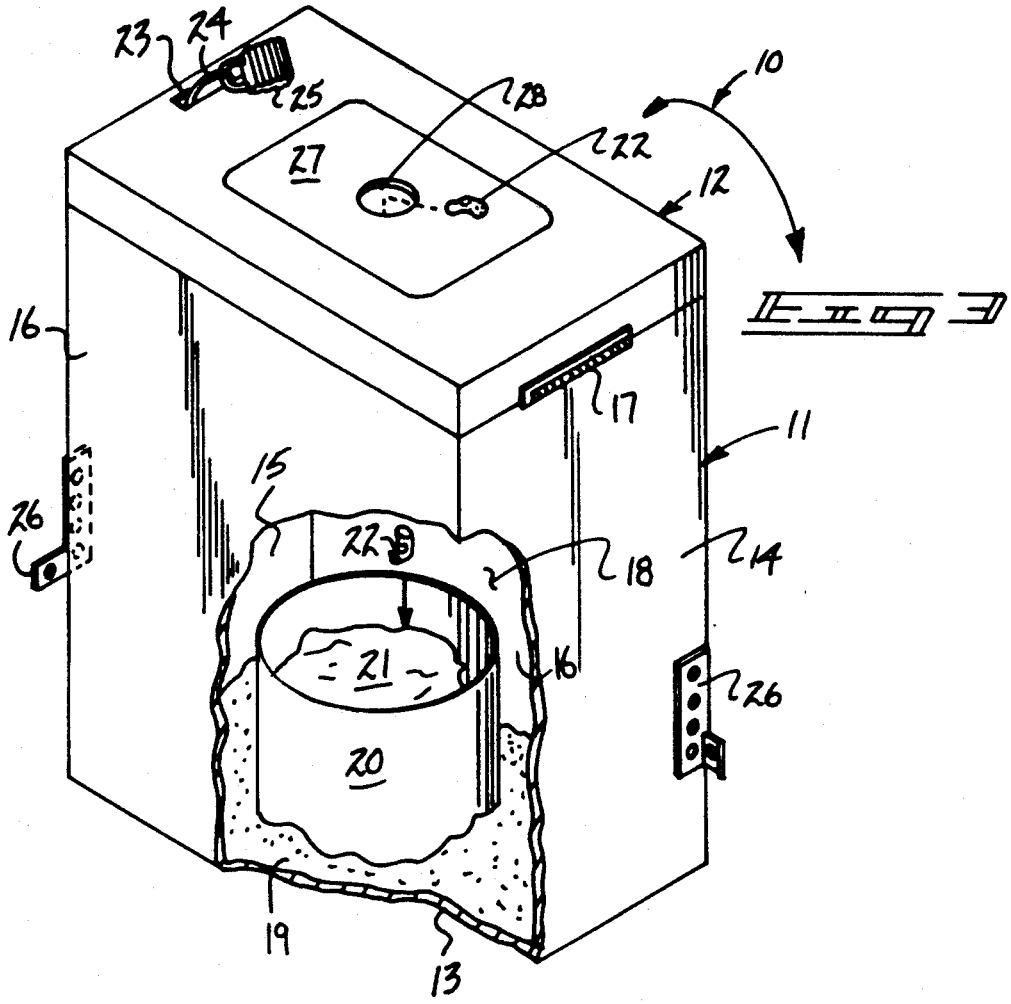
FIG. 3 is an isometric illustration, partially in section, of the instant invention.
Figure 4:
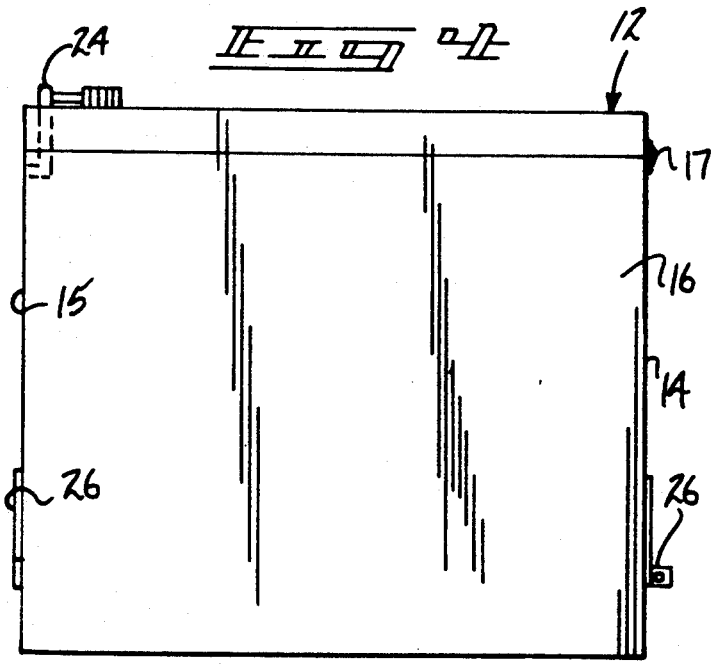
FIG. 4 is an orthographic side view of the invention.
Figure 5:
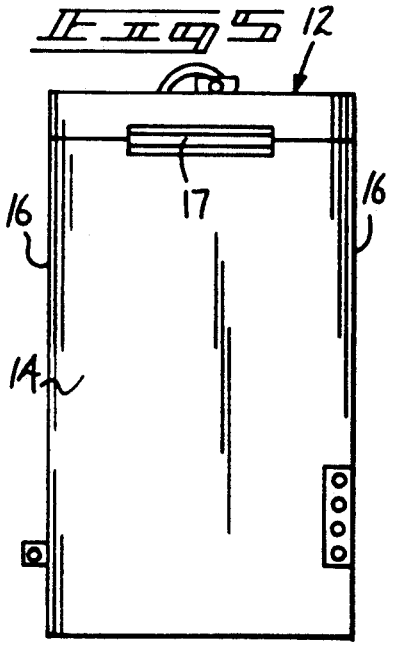
FIG. 5 is an orthographic front view of the invention.
Figure 11:
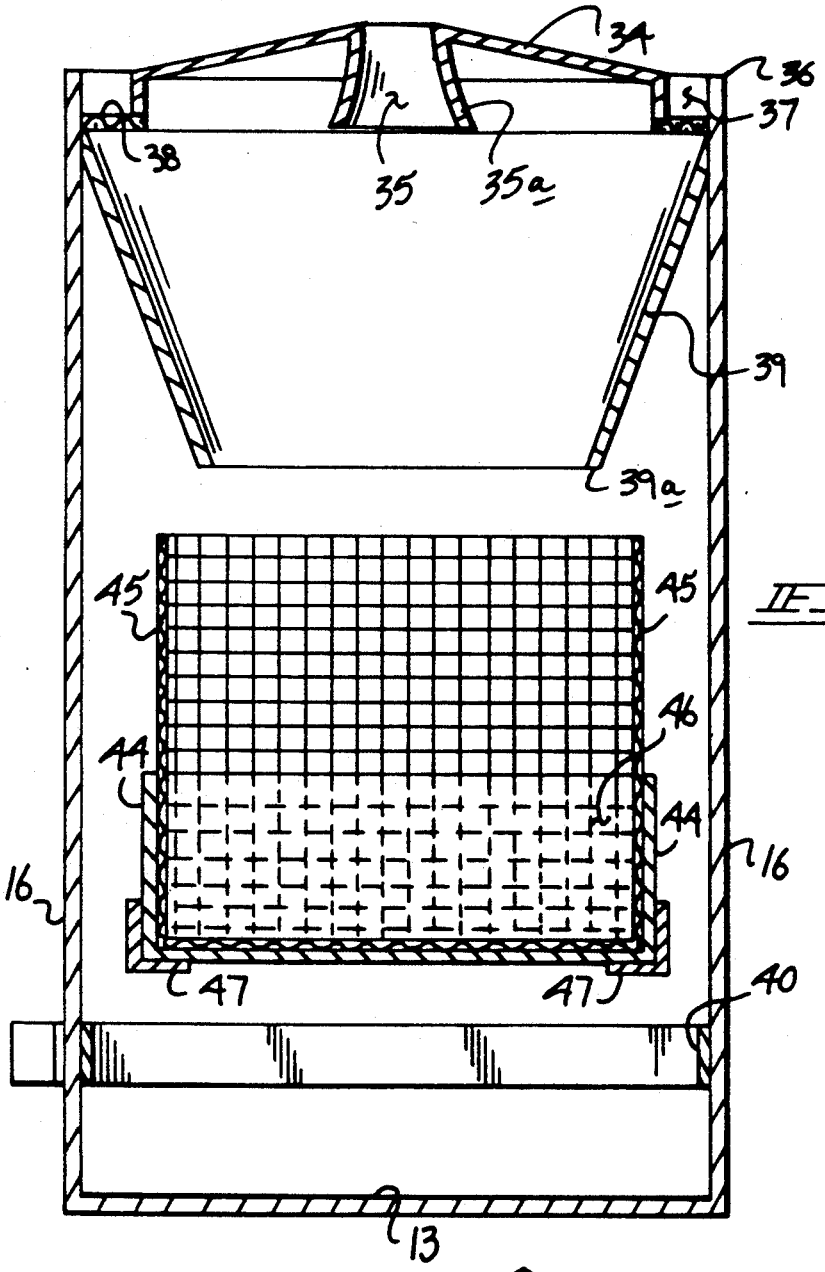
FIG. 11 is an orthographic view, taken along the lines 11—11 of FIG. 9 in the direction indicated by the arrows.
Figure 12:
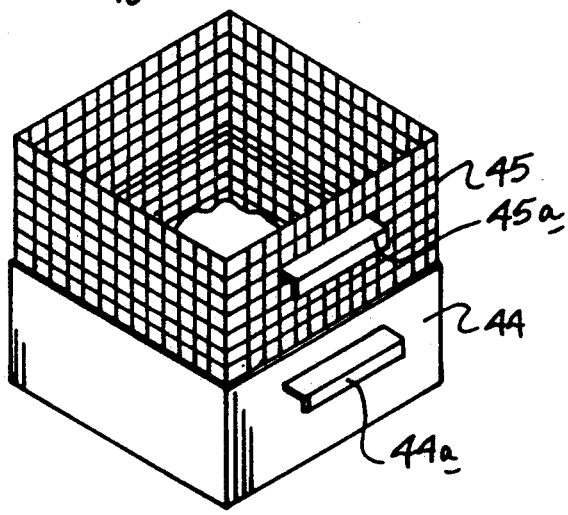
FIG. 12 is an isometric illustration of the basket container and upwardly projecting basket utilized by the invention of the embodiment as set forth in FIG. 9.

FIG. 3 illustrates the modified apparatus 10*a*, wherein the housing 32 includes a front wall 33 of a modified construction to hingedly mount a front wall door plate 41. The front wall door plate 41 includes a door latch 49, whereupon positioning of the door plate 41 within the associated front wall opening 48 permits latching of the door thereto by use of the latch 49. The housing 32 includes a convex cover hood 34 that is received in a spaced relationship relative to the housing upper continuous wall edge 36 to define a perimeter trough 37 between the wall egde 36 and the hood 34. The trough 37 includes a mesh screen floor 38 that is orthogonally oriented between the housing wall upper edge portion and the hood 34. The hood 34 includes a central conduit 35 that is formed downwardly relative to a medial portion of the hood 34 and terminates in an outwardly flared lower conduit end 35*a*. A funnel housing 39 is fixedly mounted interiorly of the housing 32 and extends downwardly from an intersection of the mesh screen floor 38 and the housing side wall, front, and rear walls. The funnel housing outlet edge 39*a* defines an opening of a predetermined width less than a container width defined by a support container 44 that mounts a basket mesh 45 and basket therewithin. The basket mesh of the basket 45 extends above and upwardly of the support container 44 and positioned outwardly and laterally beyond the funnel housing's lower outlet edge 39*a*. The support container 44 is slidably mounted upon spaced parallel tracks 47, with a fluid deodorant mixture 46 contained within the support container 44 to extinguish cigarette butts directed within the container 44. The support container 44 includes a container handle 44*a*, wherein the basket 45 includes a basket handle 45*a* to permit ease of manipulation of the basket relative to the container, and the container upon the parallel tracks 47. The parallel tracks 47 mount the basket, wherein the basket width is equal to or less than the front wall opening width to permit removal of the basket and container 45 and 44 respectively through the front wall opening. A spring clip 42 is mounted to an interior surface of the front wall door plate 41 to mount a recording ledger 43 thereon to record data regarding maintenance of the organization in use. The housing 32 further includes a reinforcing belt web 40 of rigid construction that is circumferentially mounted interiorly of the housing 32 below the parallel tracks 47, whereupon the brackets 26 are mounted through the housing in securement of the belt web 40 to provide a rigid support for the brackets in use in mounting to various wall surfaces for stationary positioning of the housing 32 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation. assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous, modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ashtray apparatus, comprising, a housing, wherein the housing includes a front wall spaced from a rear wall, spaced side walls and a floor, with the housing including a housing upper edge defining a housing upper end opening, and a convex cover hood mounted within the housing upper end opening spaced from the housing upper edge, with the convex cover hood including a central conduit projecting downwardly relative to the convex cover hood and medially thereof, wherein the central conduit includes an outwardly flared lower end, and a support container positioned within the housing below the central conduit, and the support container including a basket member positioned within the support container extending upwardly thereof.

2. An apparatus as set forth in claim 1 wherein the housing includes a perimeter trough extending between the housing upper edge and the convex cover hood, and the trough including a mesh screen floor orthogonally between the housing upper edge and the convex cover hood to define the mesh screen floor, with a funnel housing fixedly mounted to the housing at an intersection defined by the mesh screen floor and the housing front wall, rear wall, and side walls, with the funnel housing extending downwardly from the mesh screen floor defining a funnel housing outlet edge extending laterally inwardly of the housing front wall, rear wall, and side walls, and the housing outlet edge opening positioned interiorly of the basket.

3. An apparatus as set forth in claim 2 wherein the support container is slidably mounted upon spaced parallel tracks, the parallel tracks extending orthogonally between the rear wall and the front wall of the housing, and the front wall includes a front wall opening, wherein the tracks extend adjacent the front wall opening and the front wall opening is defined by a predetermined width, and wherein the support container is defined by a container width less than the predetermined width, with the container slidably mounted upon the parallel tracks to permit removal of the support container and the basket from the housing.

4. An apparatus as set forth in claim 3 with a front wall plate hingedly mounted to the front wall receivable within the front wall opening, and a door latch mounted to the door plate to permit securement of the door plate to the front wall, and the support container including a handle and the basket including a further handle to permit ease of manual manipulation of the support container and the basket relative to the housing.

5. An apparatus as set forth in claim 4 including a spring clip mounted to the door plate, with the spring clip mounting a recording ledger to permit recording of data relative to maintenance of the support container, with the support container including a fluid deodorant mixture contained therewithin arranged for selective maintenance, wherein said selective maintenance is indicated upon the recording ledger.

6. An apparatus as set forth in claim 5 wherein the housing includes a rigid, continuous reinforcing belt web mounted within the container in contiguous communication with the side walls, the front wall, and the rear wall, wherein the belt web is positioned below the front wall opening, and wherein the housing includes at least one bracket member fixedly mounted to an exterior surface of the housing secured to the belt web for permitting securement of at said least one bracket to an adjacent support.

* * * * *